US009593840B2

(12) United States Patent
Gerlach

(10) Patent No.: US 9,593,840 B2
(45) Date of Patent: Mar. 14, 2017

(54) FLAP MECHANISM WITH A LIGHT ELEMENT

(71) Applicant: WINCOR NIXDORF INTERNATIONAL GMBH, Paderborn (DE)

(72) Inventor: Tim Gerlach, Schloss Holte Stukenbrock (DE)

(73) Assignee: Wincor Nixdorf International GMBH, Paderborn (DE)

( * ) Notice: Subject to any disclaimer, the term of this patent is extended or adjusted under 35 U.S.C. 154(b) by 0 days.

(21) Appl. No.: 14/596,520

(22) Filed: Jan. 14, 2015

(65) Prior Publication Data

US 2015/0198326 A1 Jul. 16, 2015

(30) Foreign Application Priority Data

Jan. 15, 2014 (EP) ..... 14151302

(51) Int. Cl.
*F21V 33/00* (2006.01)
*G07D 11/00* (2006.01)
(Continued)

(52) U.S. Cl.
CPC ..... *F21V 33/00* (2013.01); *F21V 23/04* (2013.01); *F21V 33/006* (2013.01); *G07D 11/0018* (2013.01); *G07D 11/0021* (2013.01); *G07F 19/201* (2013.01); *G07F 19/205* (2013.01); *F21W 2131/10* (2013.01); *F21W 2131/403* (2013.01); *F21Y 2101/00* (2013.01)

(58) Field of Classification Search
CPC ..... G07F 19/201; G07F 19/203; F21V 21/30; G07D 11/0018
See application file for complete search history.

(56) References Cited

U.S. PATENT DOCUMENTS 3,965,913 A * 6/1976 Tokura ..... G07D 11/0039 221/7
4,811,828 A * 3/1989 Gotman ..... A45C 1/12 194/351
(Continued)

FOREIGN PATENT DOCUMENTS

CN 103 469 823 12/2013
CN 203 338 698 12/2013
(Continued)

OTHER PUBLICATIONS

European Search Report of Jun. 20, 2014.

*Primary Examiner* — Anh Mai
*Assistant Examiner* — Zachary J Snyder
(74) *Attorney, Agent, or Firm* — Gerald E. Hespos; Michael J. Porco; Matthew T. Hespos

(57) ABSTRACT

A flap mechanism (2) has a housing (10), a flap aperture (21) formed on the housing (10), and a flap element (20) that at least partially closes the flap aperture (21) in a closed position and can be transferred from the closed position to an open position for at least partially freeing the flap aperture. The flap element (20), in the open position, protrudes at least with an end portion (200) from the housing (10). At least one light element (22) is arranged on the flap element (20) and generates a gleam of light on the end portion (200) of the flap element (20) at least in the open position of the flap element (20).

9 Claims, 3 Drawing Sheets

(51) Int. Cl.

| | |
|---|---|
| ***G07F 19/00*** | (2006.01) |
| ***F21V 21/30*** | (2006.01) |
| ***F21V 23/04*** | (2006.01) |
| *F21W 131/10* | (2006.01) |
| *F21W 131/403* | (2006.01) |
| *F21Y 101/00* | (2016.01) |

(56) References Cited

U.S. PATENT DOCUMENTS

| | | | | |
|---|---|---|---|---|
| 8,469,264 | B1 * | 6/2013 | Almeida | G07F 19/205 235/379 |
| 2004/0060980 | A1 | 4/2004 | Shibata et al. | |
| 2004/0105255 | A1 * | 6/2004 | Seeburger | E04D 13/158 362/145 |
| 2008/0113709 | A1 | 5/2008 | Beadell et al. | |
| 2009/0080204 | A1 * | 3/2009 | Puglisi | F21S 8/02 362/371 |
| 2009/0201681 | A1 * | 8/2009 | Galke | F21S 2/00 362/249.07 |
| 2014/0090953 | A1 * | 4/2014 | Johnson | G07D 11/0051 194/344 |

FOREIGN PATENT DOCUMENTS

| | | |
|---|---|---|
| CN | 203 363 871 | 12/2013 |
| DE | 43 16 013 | 11/1993 |
| JP | 2007-319296 | 12/2007 |

* cited by examiner

FLAP MECHANISM WITH A LIGHT ELEMENT

BACKGROUND

1. Field of the Invention

The invention relates to a flap mechanism for closing an aperture on a housing.

2. Description of the Related Art

A flap mechanism of this kind comprises a housing, a flap aperture formed on the housing, and a flap element that at least partially closes the flap aperture in a closed position and can be transferred from the closed position to an open position for at least partially freeing the flap aperture.

In the open position, the flap element protrudes with at least an end portion from the housing. This is to be understood as meaning that, in the open position, the flap element is (still) visible to a user from the outside, at least with its end portion. The flap element does not necessarily protrude outward from a shell of the housing. Instead, it is also conceivable that the flap element projects, for example, beyond a housing wall by extending into the flap aperture.

In such flap elements, provision can be made, for esthetic reasons, that they cover the flap aperture in their closed position and are designed the same as the housing, such that, in its closed position, the flap element cannot be immediately distinguished from the rest of the housing. For example, if the housing and the flap element are made of comparable materials and/or have a similar color, then the flap element, in its closed position, may be discernible to the user only with difficulty, which may be advantageous from esthetic points of view.

However, this can bring with it the disadvantage that a user does not notice the flap element opening, especially if the flap element is located in a position not directly in the view of the user. For example, if a flap element from which cash is to be dispensed in an automated teller machine is located at a height not in the line of sight of the user, it is possible that the user will not readily notice that the flap element is open.

The object of the present invention is to make available a flap mechanism by which a user can be made aware of the opening of a flap element in a simple and cost-effective way.

SUMMARY OF THE INVENTION

The invention related to a flap element with at least one light element is arranged on the end portion of the flap element. The light element is designed to generate a gleam of light on the end portion of the flap element at least in the open position of the flap element.

The flap element protrudes with its end portion from the housing. The flap element can in this case protrude outward with its end portion, i.e. into an exterior surrounding the housing. However, it is also conceivable and possible that, in the open position, the flap element extends with its end portion into the flap aperture and therefore does not protrude outward from the housing but simply projects beyond a housing wall. In this connection, it is essential merely that the flap element is visible via its end portion in the open position.

To show a user that the flap element is in its open position, one or more light elements in the form of light-emitting diodes are arranged on the end portion of the flap element and light up as soon as the flap element has been transferred to its open position, thereby showing the user that the flap element is open. If the light elements shine into an area that is arranged in the field of view of a user, at least when used correctly by a user, the user will readily see the gleam of light when the flap element opens and will therefore be aware of the opened flap element.

In the closed position, the flap element preferably separates an interior of the housing from an exterior of the housing. The flap element in this case points with a rear face toward the interior. One or more light elements preferably are arranged on this rear face, which has the advantage that the light elements are not visible from the outside when the flap element is closed.

The flap element, at least in the area of its end portion, preferably is made from a light-transmitting material, for example of glass or Plexiglas, that can be painted black. The light element may be arranged on the rear face of the flap element and may be designed to shine through the flap element, so that the at least one light element generates a gleam of light that shines from the rear face of the flap element, through the flap element all the way to the front face of the flap element and is thrown out from the front face. A user looking at the front face of the flap element from the outside can see the gleam of light from the at least one light element. However, in the case of glass that has been painted black, the at least one flap element is not visible from the outside in the non-energized state, i.e. when it is not lit up, but emits a gleam of light when the light element is energized.

The flap element does not necessarily have to be made from a light-transmitting material. It is also conceivable and possible that one or more light elements are mounted at apertures in the flap element, through which a gleam of light can be radiated to the outside.

The flap element, in the closed position, may be flush with a front face of the housing, such that, especially if the flap element and the front face of the housing are made of the same material and/or are provided with the same color, the flap element, in the closed position, cannot be easily distinguished from the front face of the housing. Thus, in the closed position, the flap element is not easily discernible as such.

The flap element can be slid or pivoted into the open position where the flap element is driven at least partially into an interior of the housing. The flap element in this case protrudes with its end portion outward from the interior, in such a way that at least the end portion of the flap element can be seen easily from the outside by a user, and a gleam of light generated by one or more light elements on the end portion ensures that the user is made clearly aware of the opened flap element.

In the open position of the flap element, the at least one light element may be energized to generate a gleam of light on the end portion of the flap element. By contrast, in the closed position of the flap element, the at least one light element is switched off and accordingly is not energized, such that the at least one light element does not light up and is therefore also not visible from the outside. A control system can be provided to control the at least one light element and energize the at least one light element when the flap element is in the open position, but does not energize the at least one light element when the flap element is in the closed position.

The control unit can interact with a suitable sensor. For example, in the transfer of the flap element to its open position, the sensor can detect when the flap element has reached the open position. Depending on a sensor signal, the control system can then generate a control signal that causes the at least one light element to be energized.

The flap mechanism can, for example, be part of a terminal, for example a self-service terminal such as an automated teller machine or the like. If the terminal is designed as an automated teller machine, it is possible, for example, for cash to be dispensed via such a flap mechanism, in which case the flap mechanism opens to dispense cash and closes again after the cash has been withdrawn by a user.

The underlying concept of the invention is explained in more detail below on the basis of the illustrative embodiments shown in the figures.

DETAILED DESCRIPTION

Figure 1:
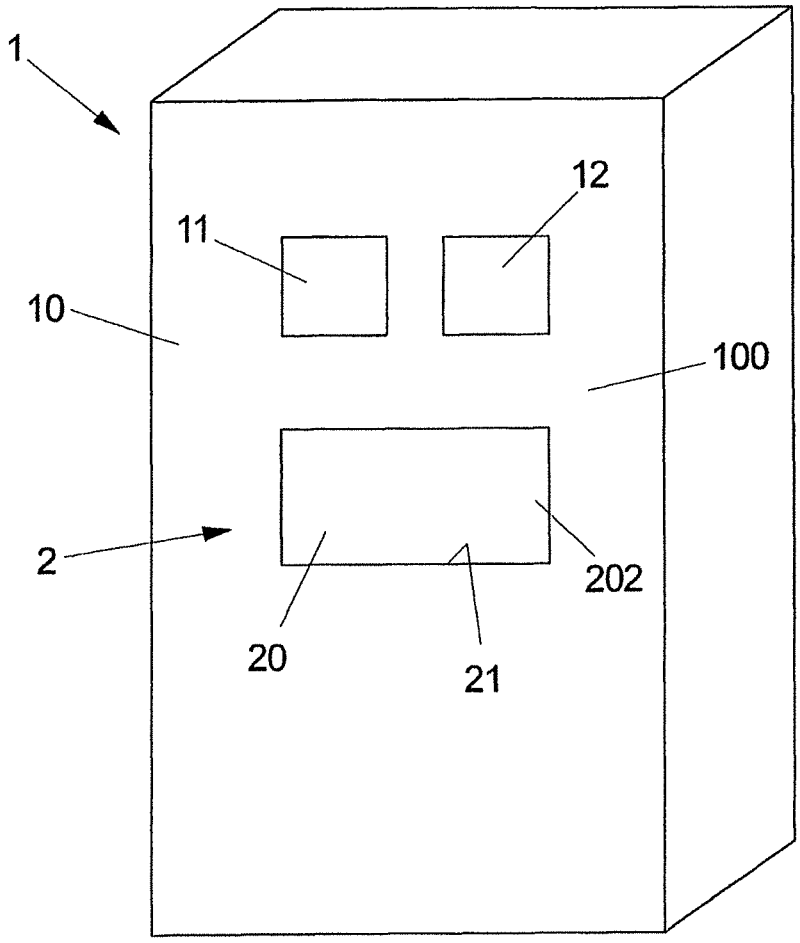
FIG. 1 shows a schematic view of a terminal with a flap mechanism.

FIG. 1 shows a schematic overview of a device 1 which is designed, for example, as a self-service terminal, for example as an automated teller machine, and has an input mechanism 11, for example for entering a security identifier (so-called PIN), and a reader 12 for reading in data of a charge card or of a credit card.

A flap mechanism 2 is provided and has a flap element 20. In a closed position, the flap element 20 closes a flap aperture 21, such that a compartment located behind the flap element 20 and bound by a housing 10 of the device 1 is not accessible from outside. If the device 1 is designed as an automated teller machine, it is possible, for example, for cash to be dispensed via the flap mechanism 2, in which case the flap element 20 opens to dispense cash so that a user can withdraw the cash, and then closes again.

Figure 2:
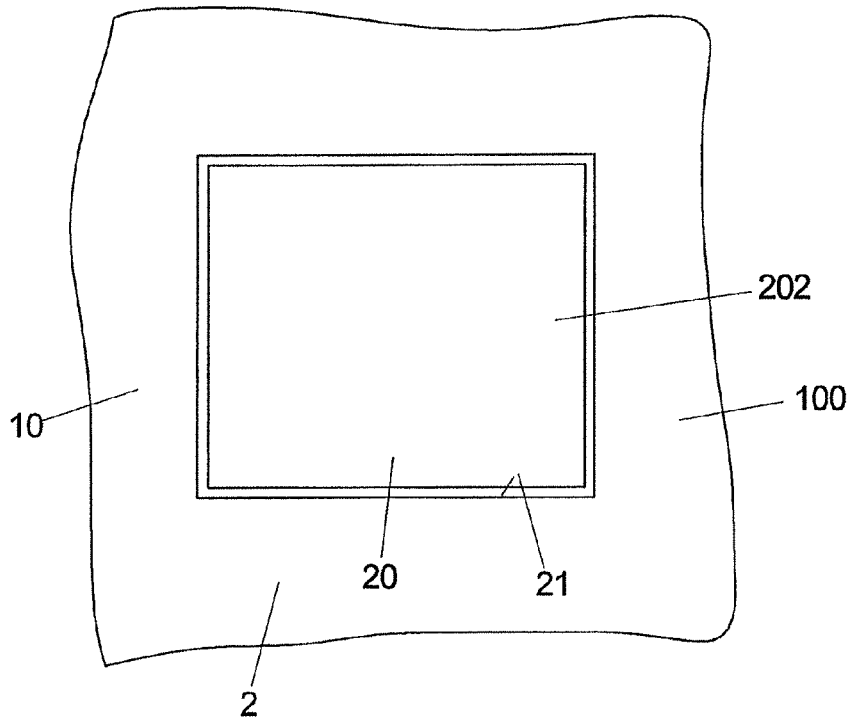
FIG. 2 shows a separate view of the flap mechanism.
Figure 3A:
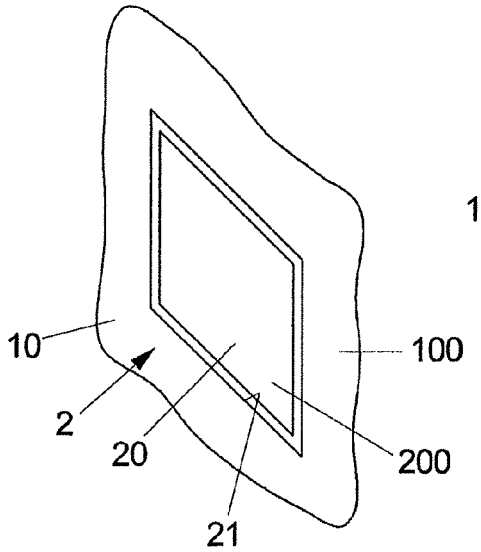
FIG. 3A shows a view of the flap mechanism in a closed position of a flap element.
Figure 3B:
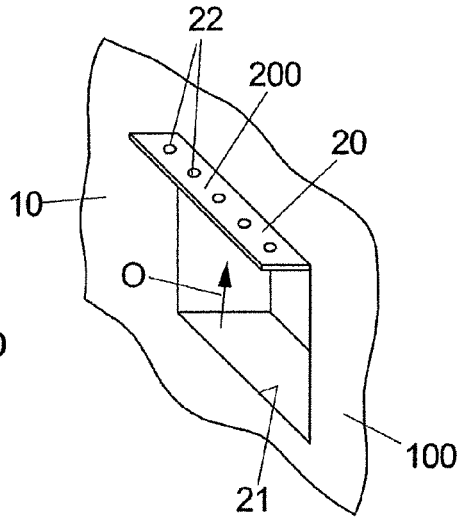
FIG. 3B shows a view of the flap mechanism with the flap element in an open position.

Separate views of an illustrative embodiment of a flap mechanism 2 are shown in FIGS. 2 and 3A and 3B. In its closed position, the flap element 20 is arranged flush with a front face 100 of the housing 10 of the device 1 and closes the flap aperture 21 formed in the housing 10. If the outside of the flap element 20 is made of the same material as the front face 100 of the housing 10 or has the same color, then the flap element 20, in its closed position, is barely discernible to a user from the outside, which may be desirable from esthetic points of view.

For example, the flap element 20 and the front face 100 of the housing 10 can be made of a glass or a Plexiglas, in which case the front face 100 and the flap element 20 can additionally be painted black.

The flap element 20 can be transferred from its closed position (FIGS. 2 and 3A) to an open position (FIG. 3B) and, for this purpose, can be moved in an opening direction O. The flap element 20 can be opened by being pivoted and at the same time at least partially driven into the flap aperture 21, such that, in the open position, an end portion 200 of the flap element 20 protrudes outward from the front face 100 of the housing 10.

Several light elements 22 in the form of light-emitting diodes are mounted on the end portion 200 and light up when the flap element 20 is located in its open position. Thus, even if the flap element 20 is not directly in view, the fact that the flap element 20 is open is made immediately and clearly apparent to a user.

Figure 4B:
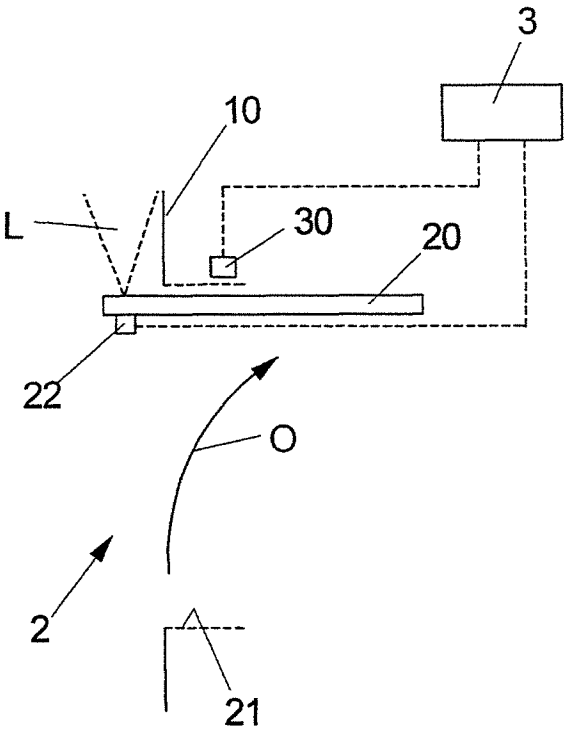
FIG. 4B shows a schematic view of the flap mechanism, with the flap element in the open position.
Figure 4A:
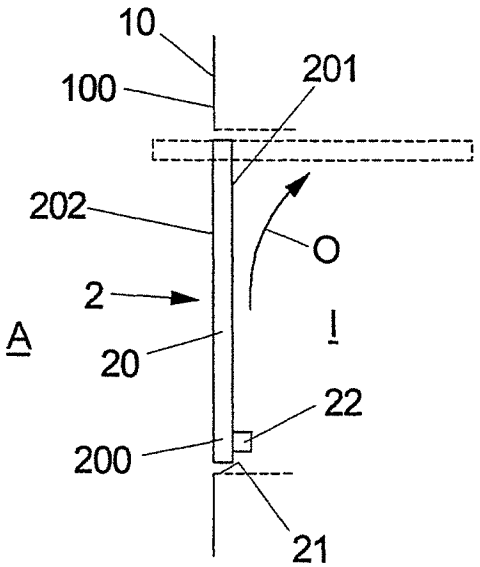
FIG. 4A shows a schematic side view of the flap mechanism, with the flap element in the closed position.

As can be seen from FIGS. 4A and 4B, the light elements 22 in the form of the light-emitting diodes are arranged on a rear face 201 of the flap element 20, facing in toward an interior I of the housing 10 and lying opposite a front face 202 of the flap element 20, and are therefore not immediately visible from the outside, i.e. from an exterior A located outside the housing 10, in the closed position of the flap element 20 (FIG. 4A). The light elements 22 are not energized in the closed position of the flap element 20 and cannot be seen easily from the outside through the flap element 20 (for example if the flap element 20 is made from glass that is painted black). By contrast, when the flap element 20 is transferred to its open position (FIG. 4B), the light elements 22 are energized and emit a gleam of light L that passes through the flap element 20 and gleams upward, such that a user positioned with his or her head above the flap mechanism 2 can easily discern the gleam of light L. As a result of the light elements 22 lighting up, the user is thus made aware of the opening of the flap element and immediately sees where the flap aperture 21 is situated. Thus, when the device 1 is designed as an automated teller machine, the user can access the flap aperture 21 and, for example, can withdraw cash that has been dispensed.

As is shown schematically in FIG. 4B, the device 1 has a control system 3, that controls the energizing of the light elements 22. The control system 3 can, for example, with a sensor 30 that detects a transfer of the flap element 20 to its open position and emits a suitable sensor signal to the control system 3. Depending on such a sensor signal, the control system 3 can cause the light elements 22 to be energized, so that the light elements 22 light up to generate a gleam of light L in the open position of the flap element 20. When the flap element 20 is closed again, the control system 3 can cause the light elements 22 to switch off so that, in the closed position of the flap element 20, no gleam of light L is generated, and the light elements 22 are accordingly not visible from the outside (FIG. 4A).

The underlying concept of the invention is not limited to the illustrative embodiments set out above and instead can in principle also be realized in entirely different kinds of embodiments.

In particular, a flap mechanism of the type described here can be used not just in an automated teller machine but also in any desired device, for example a self-service terminal such as a ticket machine, a statement printer, a general device for carrying out money transactions, or another terminal.

Moreover, the flap mechanism is not limited to the specifically described design. In particular, a flap element can also be designed in such a way that it has to be slid or pivoted in order to open it.

LIST OF REFERENCE SIGNS

1 terminal
10 housing
11 input mechanism
12 reader
2 flap mechanism
20 flap element
200 end portion
201 rear face
202 front face

21 flap aperture
22 light elements
3 control system
30 sensor
A exterior
I interior
L gleam of light
O opening direction

What is claimed is:

1. A self-service terminal, comprising:

a housing (10) with a front face;

an aperture (21) formed in the front face of the housing (10) for dispensing money, a ticket or a statement to a user of the self-service terminal;

a flap (20) mounted to the housing (10) for movement between a closed position where the flap (20) closes the aperture (21) and an open position where the flap (20) opens the aperture (21), the flap (20) having an inner surface facing into the aperture (21) when the flap (20) is in the closed position, an outer surface facing out from the front face of the housing (10) when the flap (20) is in the closed position and a free end that protrudes from the front face of the housing (10) when the flap (20) is in the open position;

at least one light element (22) in proximity to the free end of the flap (20) and being configured to emit light from the outer face of the flap (20) when the flap (20) is in the open position and when the self-service terminal is dispensing money, a ticket or a statement to the user of the self-service terminal.

2. The self-service terminal of claim 1, wherein the flap (20), in the closed position, separates an interior (I) of the housing (10) from an exterior (A) of the housing (10) and points with a rear face (201) toward the interior (I), wherein the at least one light element (22) is arranged on the rear face (201) of the flap (20).

3. The self-service terminal of claim 1, wherein the flap (20), at least in the area of the free end portion (200), is made from a light-transmitting material so that light from the light element (20) is transmitted through the free end portion (200) of the flap (20) protruding from the front face of the housing (10) when the flap (20) is in the open position.

4. The self-service terminal of claim 1, wherein the at least one light element (22) is a light-emitting diode.

5. The self-service terminal of claim 1, wherein the flap (20), in the closed position, is arranged flush with a front face (100) of the housing (10).

6. The self-service terminal of claim 1, wherein the flap (20), in the open position, is driven at least partially into an interior (I) of the housing (10) and protrudes with the free end portion (200) outward through the aperture (21).

7. The self-service terminal of claim 1, wherein the flap (20) translates and pivots during the movement from the closed position to the open position.

8. The self-service terminal of claim 1, wherein the at least one light element (22) is a light-emitting diode mounted to the inner surface of the flap (20) and emitting light through a region of the flap (20) in proximity to the free end thereof and from the outer surface of the flap when the flap is in the open position.

9. The self-service terminal of claim 1, further comprising a control system (3) connected for control purposes to the at least one light element (22), the control system (3) including at least one sensor (30) disposed to sense movement of the flap (20) into the open position and the control system (3) is designed to control the at least one light element (22) so that the at least one light element (22) is not energized in the closed position, but the control system (3) is configured to energize the at least one light element (22) when the at least one sensor (30) senses the movement of the flap (20) into the open position to emit a gleam of light (L) through the flap element (20) in proximity to the free end portion (200).

* * * * *